US007429192B2

(12) United States Patent
Liao et al.

(10) Patent No.: US 7,429,192 B2
(45) Date of Patent: Sep. 30, 2008

(54) ELECTRONIC DEVICE WITH SHIELD

(75) Inventors: Feng-Liang Liao, Taipei Hsien (TW); Wei-Hsi Chen, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/615,017

(22) Filed: Dec. 22, 2006

(65) Prior Publication Data

US 2008/0096422 A1 Apr. 24, 2008

(30) Foreign Application Priority Data

Oct. 20, 2006 (TW) ..... 095138883

(51) Int. Cl.
*H01R 13/60* (2006.01)

(52) U.S. Cl. ..... 439/567

(58) Field of Classification Search ..... 439/567, 439/571, 572, 607, 609; 361/818, 816; 174/35 C, 174/138 D; 411/349, 438
See application file for complete search history.

(56) References Cited

U.S. PATENT DOCUMENTS 4,731,925 A * 3/1988 Tanishi et al. ..... 29/840
5,938,473 A * 8/1999 Nishio et al. ..... 439/567
6,083,043 A * 7/2000 Lok ..... 439/567
6,178,097 B1 1/2001 Hauk, Jr.
6,239,359 B1 * 5/2001 Lilienthal et al. ..... 174/370
D522,517 S * 6/2006 Latawiec et al. ..... D14/432
2001/0053070 A1 * 12/2001 Kitamura et al. ..... 361/818
2005/0141211 A1 * 6/2005 Chen ..... 361/816

* cited by examiner

*Primary Examiner*—Alexander Gilman
(74) *Attorney, Agent, or Firm*—Wei Te Chung

(57) ABSTRACT

An electronic device (10) includes a circuit board (40) and a shield (20). The circuit board includes a pair of mounting holes (44), a first surface (41), a second surface (43) opposite to the first surface, and at least one electronic component (42). The shield includes a top wall (26), a pair of first sidewalls (22), a pair of second sidewalls (24) opposite to the first sidewalls, and a pair of mounting members (23). The top wall, the first sidewalls, and the second sidewalls cooperatively bound a receiving portion (28) for receiving the electronic component. The mounting members extend respectively from the first sidewalls toward the circuit board corresponding to the mounting holes of the circuit board. At least one gap (220) is formed between each of the mounting members and each of the first sidewalls.

19 Claims, 8 Drawing Sheets

ELECTRONIC DEVICE WITH SHIELD

BACKGROUND OF THE INVENTION

1. Field of the Invention

The present invention relates to electronic devices, and particularly to an electronic device with a shield having mounting members.

2. Description of Related Art

EMI occurs between neighboring electronic components or circuits due to inductive coupling therebetween. EMI sources include inverters, diodes, transistors, amplifiers, power supplies, and other circuits of electronic devices. The effective performance of electronic devices can be interrupted, obstructed, or degraded by EMI. One popular solution developed to avoid problems from EMI is to employ a metal shield to absorb as much EMI as possible.

A conventional RF (Radio Frequency) shield 600 is shown in FIG. 8. The RF shield 600 comprises a cover 610 and a frame 620. The cover 610 is a central portion of the RF shield 40, and is surrounded and defined by a peripheral score line 611. Four corner portions of the cover 610 are bent upwardly to form four bent portions 612, for facilitating removal of the cover 610 from the frame 620 by means of a tool such as a screwdriver. However, once the cover 610 is removed from the frame 620, the RF shield 600 cannot be used again.

Therefore, a heretofore unaddressed need exists in the industry to overcome the aforementioned deficiencies and inadequacies.

SUMMARY OF THE INVENTION

In an exemplary embodiment, an electronic device includes a circuit board and a shield. The circuit board includes a first surface and a second surface at opposite sides thereof, a pair of mounting holes, and at least one electronic component. Each of the mounting holes comprises a passage portion, and a receiving portion communicating with the passage portion. Each of the passage portion and the receiving portion spans from the first surface to the second surface. The shield includes a top wall, a pair of opposite first sidewalls, a pair of opposite second sidewalls, and a pair of mounting members. The top wall, the first sidewalls, and the second sidewalls cooperatively bound a receiving portion for receiving the electronic component. The mounting members extend respectively from the first sidewalk toward the circuit board, and correspond to the mounting holes of the circuit board. At least one gap is formed between each of the mounting members and each of the first sidewalls.

In another exemplary embodiment, a shield includes a pair of first sidewalls, a pair of second sidewalls opposite to the first sidewalls, a top wall connected to the first sidewalls and the second sidewalls, and a receiving portion bounded by the top wall, the first sidewalls, and the second sidewalls cooperatively. At least one mounting member extends from each of the first sidewalls. The mounting member includes a bending portion extending from a middle of the first sidewall and a retaining portion.

Other advantages and novel features will become more apparent from the following detailed description of preferred embodiments when taken in conjunction with the accompanying drawings, in which:

DETAILED DESCRIPTION OF THE INVENTION

Figure 1:
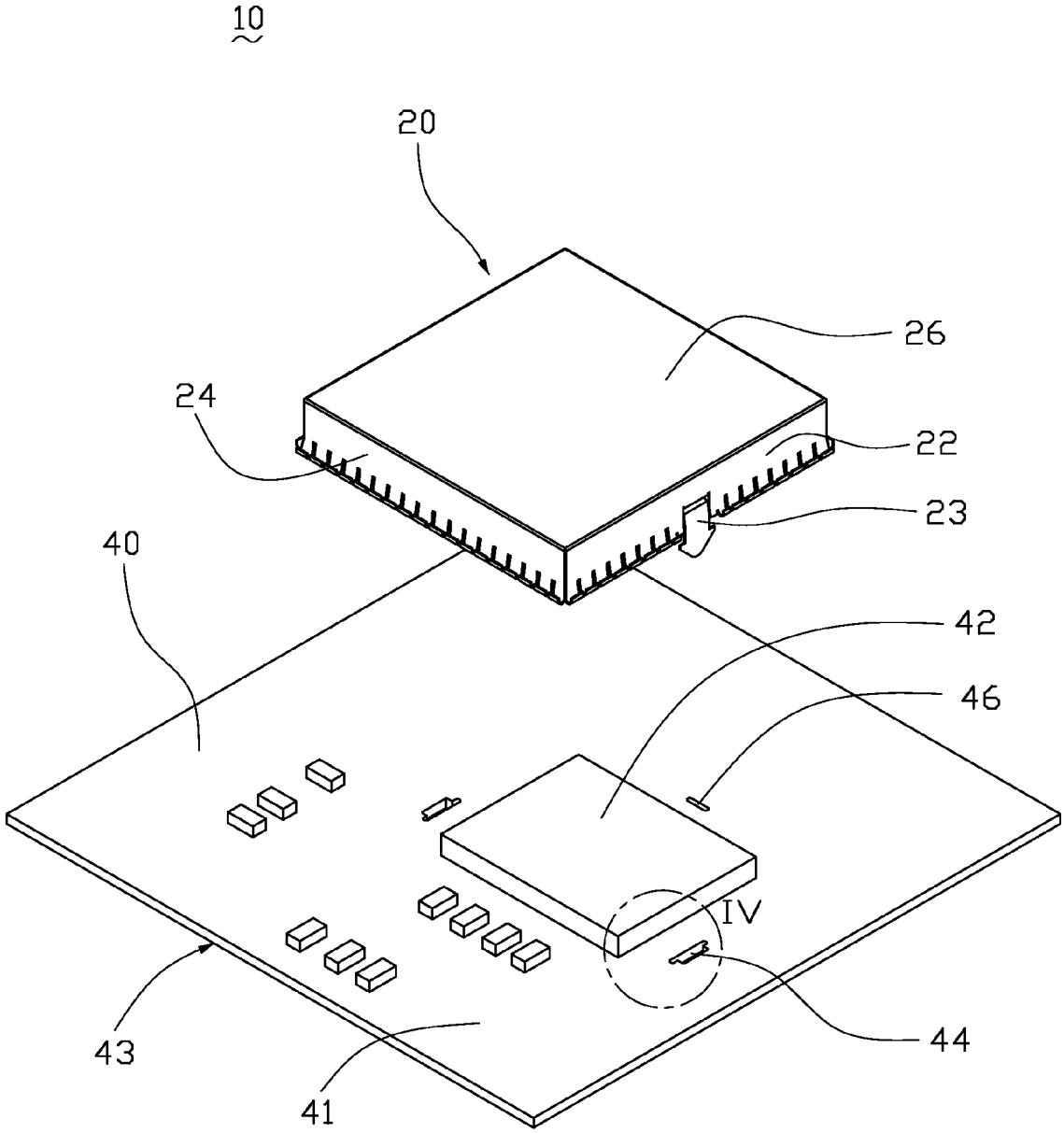
FIG. 1 is an exploded, isometric view of an electronic device in accordance with a first embodiment of the present invention, the electronic device comprising a shield and a circuit board.

FIG. 1 is an exploded, isometric view of an electronic device 10 in accordance with a first embodiment of the present invention. The electronic device comprises a shield 20 and a circuit board 40.

Figure 4:
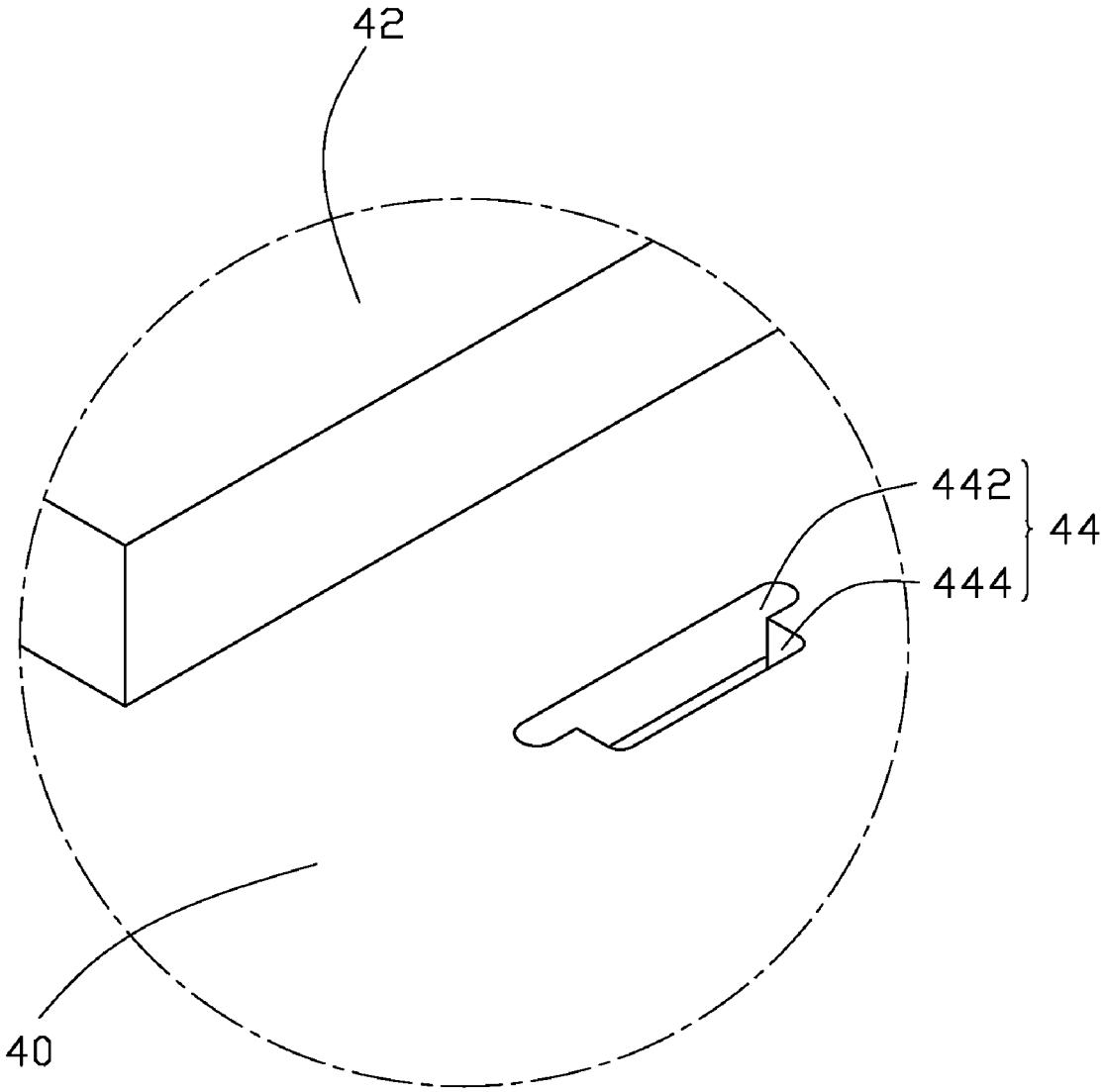
FIG. 4 is an enlarged view of a circled portion IV of FIG. 1.
Figure 5:
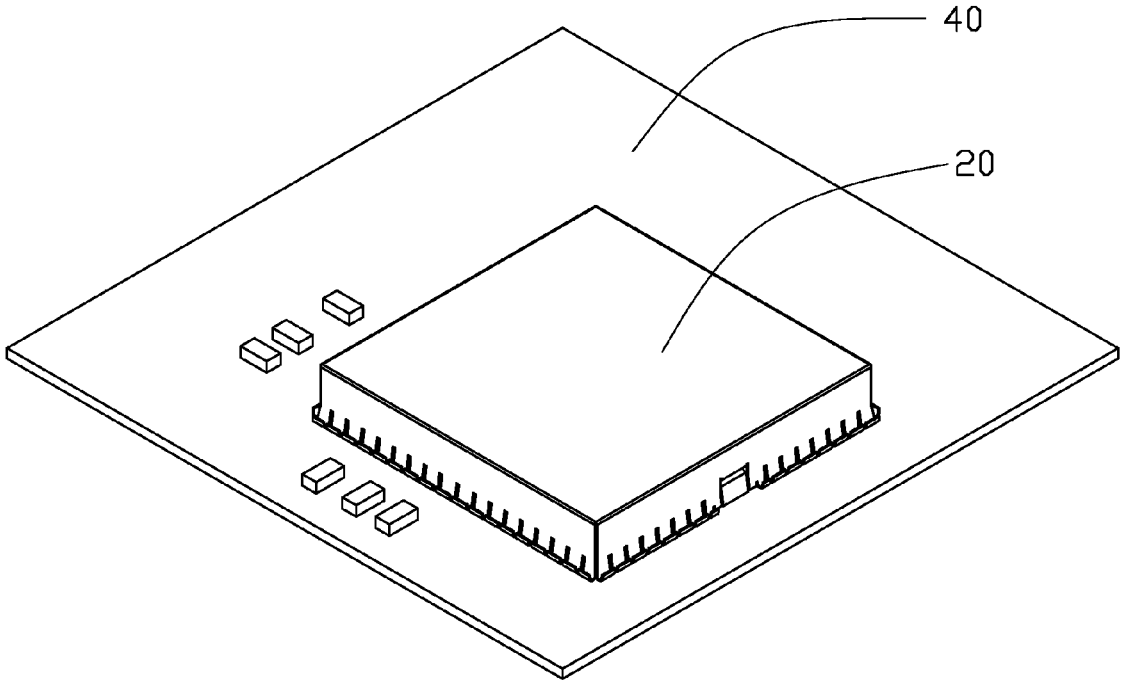
FIG. 5 is an assembled view of FIG. 1.

Referring to FIGS. 1 and 4, the circuit board 40 comprises a first surface 4 and a second surface 43 at opposite sides thereof, an electronic component 42, a locating hole 46, and a pair of mounting holes 44 located at opposite sides of the electronic component 42. The mounting holes 44 and the locating hole 46 extend through the circuit board 40. Each of the mounting holes 44 is generally T-shaped. Each mounting hole 44 comprises a passage portion 442, and a receiving portion 444 communicating with the passage portion 442. Each of the passage portion 442 and the receiving portion 444 spans from the first surface 41 to the second surface 43. A width of the passage portion 442 is greater than that of the receiving portion 444. A distance between the two receiving portions 444 is greater than that between the two passage portions 442.

Figure 2:
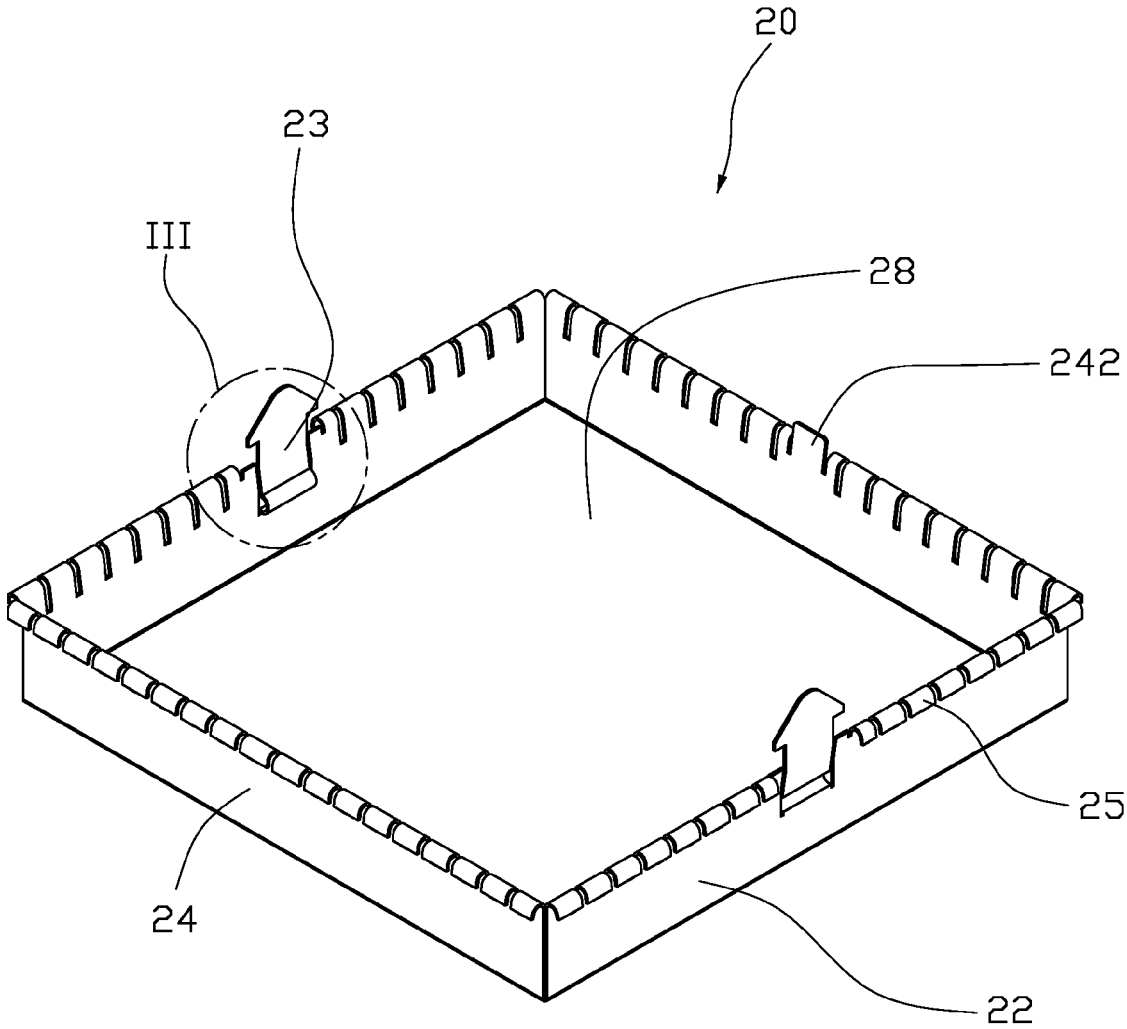
FIG. 2 is an isometric, inverted view of the shield of FIG. 1.
Figure 3:
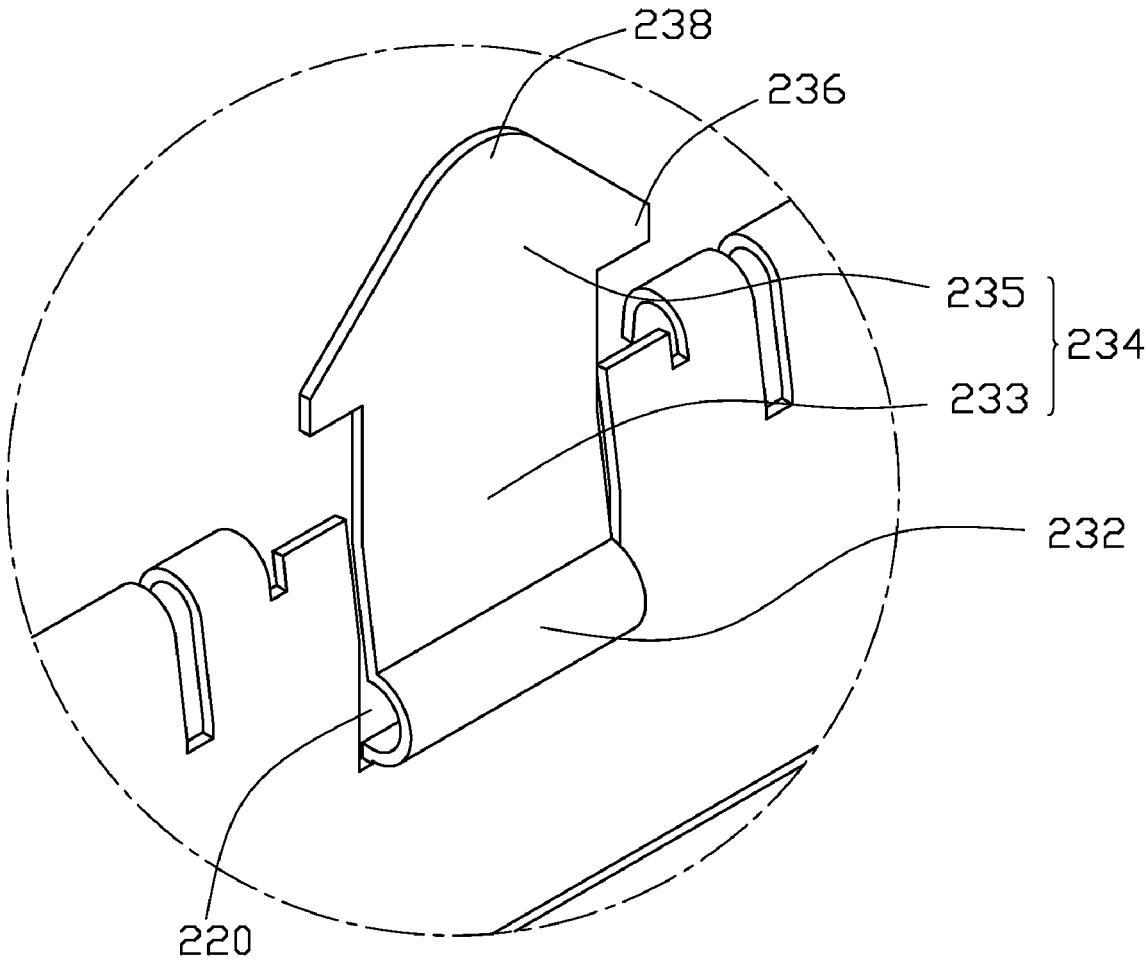
FIG. 3 is an enlarged view of a circled portion II of FIG. 2.

Referring to FIGS. 2-3, the shield 20 comprises a top wall 26, a pair of opposite first sidewalls 22, a pair of opposite second sidewalls 24, and a pair of mounting members 23. Each of the first sidewalls 22 is connected perpendicularly to each of the second sidewalls 24. The first and second sidewalls 22, 24 are connected perpendicularly to the top wall 26. The top wall 26, and the first and second sidewalls 22, 24 cooperatively surround a receiving portion 28. The electronic component 42 of the circuit board 40 is received in the receiving portion 28. Each of the mounting members 23 generally extends down from a middle of the respective first sidewall 22. A pair of parallel gaps 220 is formed between each mounting member 23 and the corresponding first sidewall 22, Each mounting member 23 comprises a curved bending portion 232, and an arrow shaped retaining portion 234 depending from an end of the bending portion 232. The bending portion 232 and the pair of gaps 220 provide the mountin member 23 with resiliency so that the retaining portion 234 is resiliently movable along directions substantially perpendicular to the corresponding first sidewall 22. In the embodiment, the bending portion 232 has a semicircular shape. The retaining portion 234 comprises a connecting portion 233 and a hook 235 extending from an end of the connecting portion 233. The hook 235 is triangular shaped with a rounded top 238. A greatest width of the hook 235 is greater than that of the connecting portion 233, and portions of the hook 235 greater in width than the connecting portion 233 form a pair of fixing portions 236. The greatest width of the book 235 is less than the width of the passage portion 442, but is greater than the width of the receiving portion 444. A distance between the two hooks 235 is equal to or slightly greater than that between the two receiving portions 444. A locating portion 242 extends from an end of one of the second sidewalls 24. A plurality of resilient portions 25 extends from a distal end of each of the first and second sidewalls 22, 24, with the resilient portions 25 being bent away from the receiving space 28. In an alternative embodiment, the resilient portions 25 are bent toward the receiving space 28.

Referring to FIGS. 1-5, in assembly, the locating portion 242 of the shield 20 is received in the locating hole 46 of the circuit board 40, and the mounting members 23 of the shield 20 are inserted into the passage portions 442 of the circuit board 40 until the fixing portions 236 of the hooks 235 pass beyond the second surface 43 of the circuit board 40. Then the retaining portions 234 of the mounting members 23 are moved to the receiving portions 444 by means of the resiliency of the mounting members 23 until the fixing portions 236 of the hooks 235 securely clasp the second surface 43 of the circuit board 20. Thus, the shield 20 and the circuit board 40 are assembled into an assembly. In this position, the resilient portions 25 are resiliently deformed so that the resilient portions 25 closely engage with a ground portion of the circuit board 40. This enforces an effect of the shield 20 in preventing electromagnetic interference (EMI).

In disassembly, the retaining portions 234 of the mounting members 23 are pressed until they are received in the passage portions 442 of the mounting holes 44, so that the shield 20 is disengaged from the circuit board 40. That is, assembling or disassembling of the shield 20 and the circuit board 40 are simple. Therefore, it is convenient to remove the electrical component 42 of the circuit board 40 for maintenance or replacement.

Because the shield 20 is directly assembled to the circuit board 40 via the mounting members 23 of the shield 20, there is no soldering during the assembling or disassembling the shield 20 and the circuit board 40. In addition, the shield 20 can be used repeatedly.

Because the fixing portions 236 of the hooks 235 of the shield 20 securely clasp the second surface 43 of the circuit board 40, the shield 20 cannot be accidentally disengaged from the circuit board 40 during use.

Because the greatest width of the hook 235 is less than the width of the passage portion 442, the mounting members 23 can easily pass through the passage portion 442 of the circuit board 40. Therefore, the shield 20 can be easily mounted to the circuit board 40.

Figure 6:
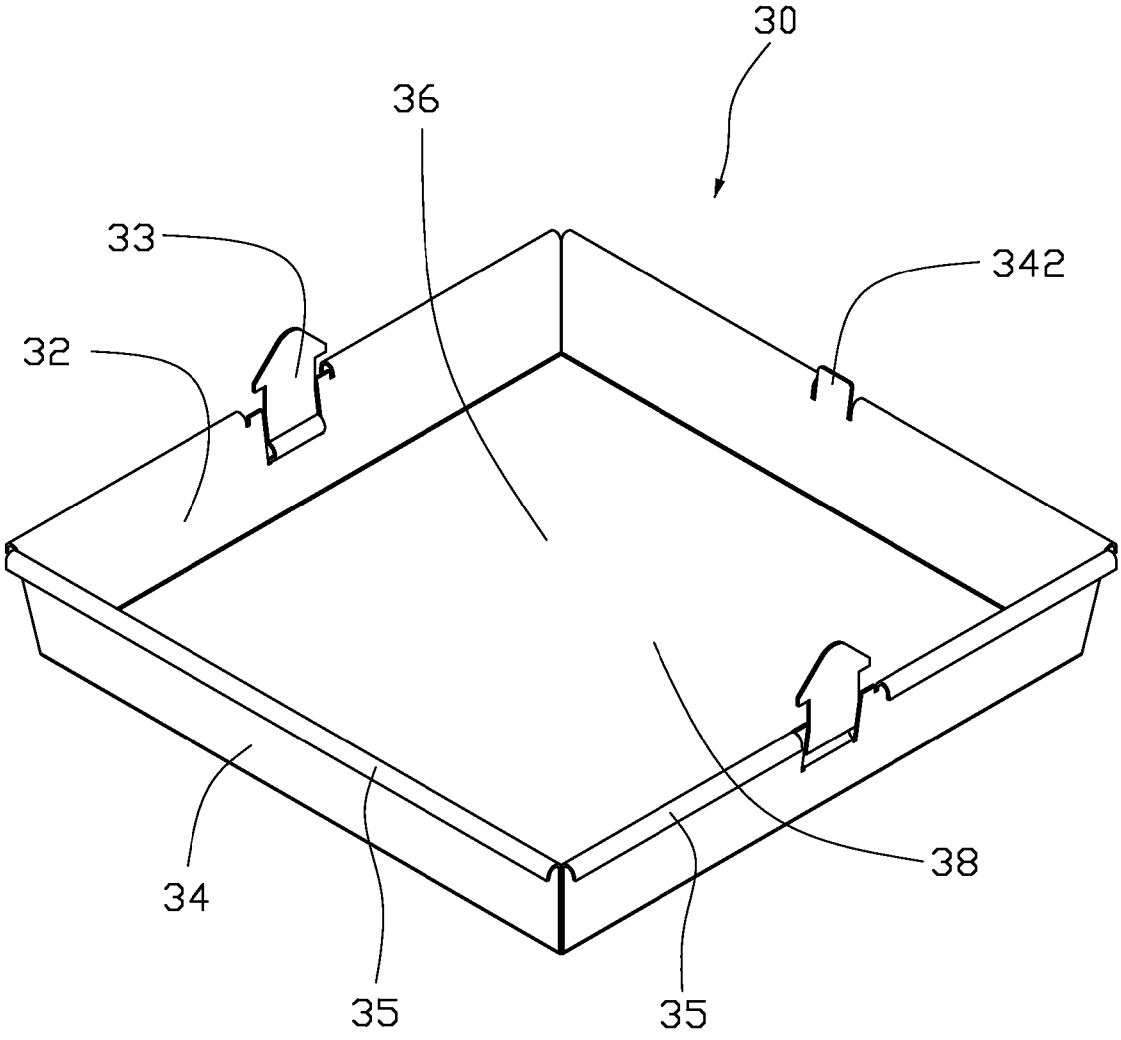
FIG. 6 is an isometric, inverted view of a shield in accordance with a second embodiment of the present invention.

FIG. 6 discloses a shield 30 in accordance with a second embodiment of the present invention. The shield 30 has a structure similar to that of the shield 20. The shield 30 comprises a pair of first sidewalls 32, a pair of second sidewalls 34, a top wall 36, and a receiving space 38 bounded by the first and second sidewalls 32, 36 and the top wall 36. Each of the first and second sidewalls 32, 34 extend obliquely from distal edges of the top wall 36. A resilient portion 35 extends from a distal end of each of the first and second sidewalls 32, 34 bent back relative to the receiving space 38, and a length of the resilient portion 35 is equal to a length of each of the first and second sidewalls 32, 34. In an alternative embodiment, the resilient portion 35 is bent toward the receiving space 38. A mounting member 33 extends from a middle of each of the first sidewalls 32 toward the circuit board 40 (see FIG. 1), thereby the resilient portion 35 located in the first sidewalls 32 is divided into two. A locating portion 342 extends from an end of one of the second sidewalls 34, thereby the resilient portion 35 located in the second sidewall 34 is divided into two. The shield 30 can perform substantially the same functions as the shield 20 described above.

Figure 7:
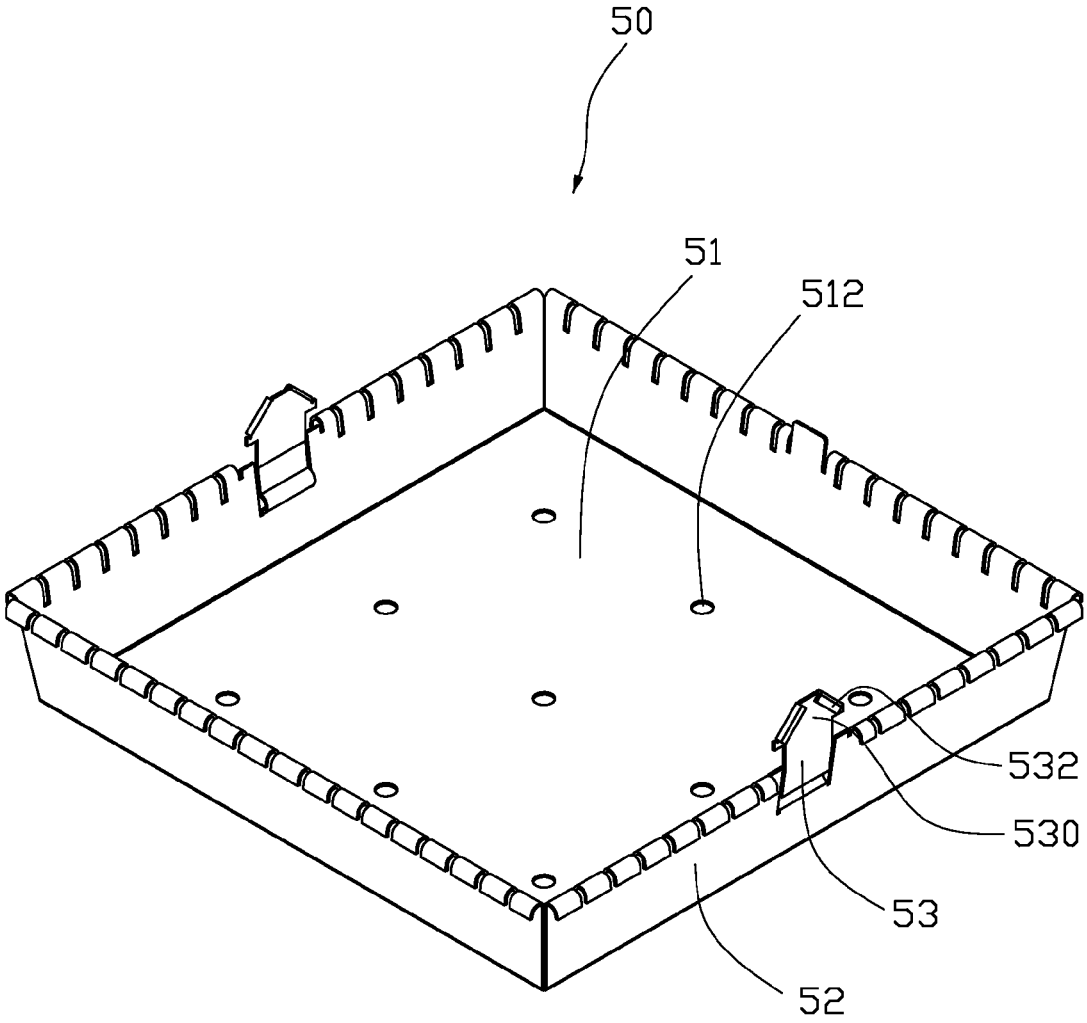
FIG. 7 is an isometric, inverted view of a shield in accordance with a third embodiment of the present invention.
Figure 8:
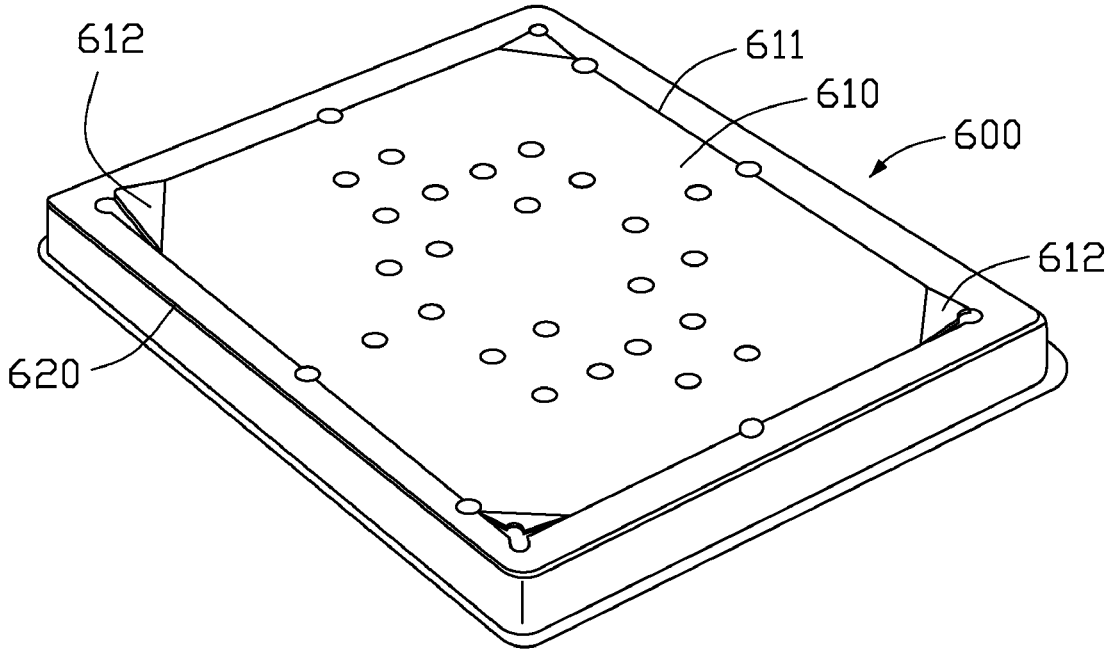
FIG. 8 (RELATED ART)
FIG. 8 is an isometric view of a conventional EMI shield used in electronic devices.

FIG. 7 discloses a shield 50 in accordance with a third embodiment of the present invention. The shield 50 has a structure similar to that of the shield 20. The shield 50 comprises a plurality of heat holes 512 defined in a top wall 51 to dissipate heat generated by the electronic component 42 of the circuit board 40 (see FIG. 1). The shield 50 further comprises a pair of mounting members 53 extending from a middle of a pair of first sidewalls 52 respectively. Each of the mounting members 53 comprises a hook 530 located in a distal end thereof. The hook 530 comprises a pair of hems 532 bent from two sides thereof to prevent a user of the circuit board 40 from accidentally hurting themselves. The shield 50 can perform substantially the same functions as the shield 20 described above.

While exemplary embodiments have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. An electronic device comprising:

a circuit board comprising a first surface, a second surface opposite to the first surface, a pair of mounting holes extending from the first surface to the second surface, and at least one electronic component, each of the mounting holes comprising a passage portion and a receiving portion communicating with the passage portion, each of the passage portion and the receiving portion spanning from the first surface to the second surface; and a shield comprising a top wall, a pair of first sidewalls, a pair of second sidewalls opposite to the first sidewalls, and a pair of mounting members, the top wall, the first sidewalls, and the second sidewalls cooperatively bounding a receiving portion for receiving the at least one electronic component, the mounting members extending respectively from the first sidewalls toward the circuit board and corresponding to the mounting holes of the circuit board, a pair of gaps formed between each of the mounting members and the corresponding first sidewall.

2. The electronic device as claimed in claim 1, wherein at least one resilient portion extends from an end of each of the first and second sidewalls and is bent in relative to the receiving space.

3. The electronic device as claimed in claim 1, wherein a locating portion extends from an end of one of the second sidewalls, and the circuit board defines a locating hole for receiving the locating portion.

4. The electronic device as claimed in claim 1, wherein the mounting member comprises a curved bending portion extending from a middle of the first sidewall, and a retaining portion.

5. The electronic device as claimed in claim 4, wherein the retaining portion comprises a connecting portion extending from an end of the bending portion, and a hook having a triangular shape with a rounded top.

6. The electronic device as claimed in claim 5, wherein a greatest width of the hook is greater than a width of the connecting portion.

7. The electronic device as claimed in claim 6, wherein a width of the passage portion is greater than that of the receiving portion, and is greater than the greatest width of the hook, and the greatest width of the hook is greater than that of the receiving portion.

8. The electronic device as claimed in claim 5, wherein a pair of hems is formed on the hook.

9. The electronic device as claimed in claim 5, wherein portions of a widest part of the hook form a pair of fixing portions.

10. The electronic device as claimed in claim 9, wherein when the shield is mounted to the circuit board, the fixing portions securely clasp the second surface of the circuit board.

11. An electronic device comprising:

a circuit board defining a surface thereon, at least one mounting hole formed at said surface and extending through said circuit board;

at least one electronic component disposed on said surface of said circuit board beside said at least one mounting hole; and a shield removably installable on said surface of said circuit board to electrically enclose said at least one electronic component in a space defined between said shield and said surface of said circuit board, said shield comprising at least one mounting member corresponding to said at least one mounting hole of said circuit board and extending toward said surface of said circuit board, said at least one mounting member resiliently movable along a first direction parallel to said surface of said circuit board so that said at least one mounting member is able to move toward said surface into said corresponding at least one mounting hole of said circuit board and through said circuit board along said corresponding at least one mounting hole, and movable along a second direction reverse to said first direction so that said at least one mounting member engages with said circuit board to secure said shield to said circuit board, wherein said at least one mounting member comprises a curved bending portion extending from a middle of at least one of a pair of first sidewalls of said shield, and a retaining portion extending from the curved bending portion.

12. The electronic device as claimed in claim 11, wherein said shield comprises a top wall, said pair of opposite first sidewalls, and a pair of opposite second sidewalls, said top wall, said first sidewalls, and said second sidewalls cooperatively bounding a receiving portion for receiving said at least one electronic component.

13. The electronic device as claimed in claim 12, wherein said at least one mounting member is formed at said at least one of said first sidewalls, and a pair of gaps is formed between said at least one mounting member and said at least one of said first sidewalls.

14. The electronic device as claimed in claim 12, wherein at least one resilient portion extends from an end of each of said first and second sidewalls and is bent in relative to said receiving space, and a locating portion extends from an end of one of said second sidewalls.

15. The electronic device as claimed in claim 11, wherein said at least one mounting hole comprises a passage portion and a receiving portion communicating with said passage portion, both of said passage portion and said receiving portion formed at said surface and extending through said circuit board.

16. The electronic device as claimed in claim 15, wherein a width of said passage portion is greater than that of said receiving portion.

17. The electronic device as claimed in claim 11, wherein said bending portion has a semicircular shape, and said retaining portion comprises a connecting portion extending from an end of said bending portion, and a hook having a triangular shape with a rounded top.

18. The electronic device as claimed in claim 17, wherein a greatest width of said hook is greater than a width of said connecting portion.

19. The electronic device as claimed in claim 18, wherein portions of a widest part of said hook form a pair of fixing portions, and when said shield is installed on said circuit board, said fixing portions securely clasp said circuit board.

* * * * *